US005725689A

United States Patent [19]

Nishida et al.

[11] Patent Number: 5,725,689

[45] Date of Patent: Mar. 10, 1998

[54] STEEL WIRE OF HIGH STRENGTH EXCELLENT IN FATIGUE CHARACTERISTICS

[75] Inventors: Seiki Nishida; Junji Nakashima; Osami Serikawa; Ikuo Ochiai, all of Kimitsu, Japan

[73] Assignee: Nippon Steel Corporation, Tokyo, Japan

[21] Appl. No.: 553,283

[22] PCT Filed: Oct. 5, 1994

[86] PCT No.: PCT/JP94/01665

§ 371 Date: Nov. 28, 1995

§ 102(e) Date: Nov. 28, 1995

[87] PCT Pub. No.: WO95/26422

PCT Pub. Date: Oct. 5, 1995

[30] Foreign Application Priority Data

Mar. 28, 1994 [JP] Japan ..... 6-057261

[51] Int. Cl.[6] ..... C22C 38/026

[52] U.S. Cl. ..... 148/320; 148/333

[58] Field of Search ..... 148/595, 320, 148/333

[56] References Cited

U.S. PATENT DOCUMENTS 5,211,772 5/1993 Ashida et al. ..... 148/595

FOREIGN PATENT DOCUMENTS

| | | |
|---|---|---|
| 50-71507 | 6/1975 | Japan . |
| 50-81907 | 7/1975 | Japan . |
| 55-24961 | 2/1980 | Japan . |
| 56-5915 | 1/1981 | Japan . |
| 60-204865 | 10/1985 | Japan . |
| 62-99436 | 5/1987 | Japan . |
| 62-99437 | 5/1987 | Japan . |
| 63-24046 | 2/1988 | Japan . |
| 3-2352 | 1/1991 | Japan . |
| 4-6211 | 1/1992 | Japan . |

*Primary Examiner*—Deborah Yee

*Attorney, Agent, or Firm*—Kenyon & Kenyon

[57] ABSTRACT

The present invention provides a steel wire rod of high strength and a steel wire of high strength excellent in fatigue characteristics used for an extra fine steel wire of high strength and high ductility which is used for a steel cord, a belt cord, and the like for reinforcing rubbers and organic materials such as a tire, a belt and a hose, and for a steel wire of high strength which is used for a rope, a PC wire, and the like. The steel of the present invention comprises, based on mass, 0.7 to 1.1% of C, 0.1 to 1.5% of Si, 0.1 to 1.5% of Mn, up to 0.02% of P, up to 0.02% of S and the balance Fe and unavoidable impurities, and contains nonmetallic inclusions at least 80% of which comprise 4 to 60% of CaO+MnO, 22 to 87% of $SiO_2$ and 0 to 46% of $Al_2O_3$ and have melting points up to 1,500° C.

6 Claims, 7 Drawing Sheets

| | CaO+MnO% | $SiO_2$ % | $Al_2O_3$ % |
|---|---|---|---|
| a | 3.5 | 86.5 | 10.0 |
| b | 34.1 | 65.9 | 0 |
| c | 41.7 | 58.3 | 0 |
| d | 52.2 | 47.8 | 0 |
| e | 56.3 | 43.7 | 0 |
| f | 49.3 | 33.4 | 17.3 |
| g | 32.0 | 22.3 | 45.7 |
| h | 29.5 | 31.7 | 38.8 |
| i | 23.6 | 36.0 | 40.4 |
| j | 14.5 | 52.0 | 33.5 |

STEEL WIRE OF HIGH STRENGTH EXCELLENT IN FATIGUE CHARACTERISTICS

FIELD OF THE INVENTION

The present invention relates a steel wire rod of high strength and a steel wire of high strength excellent in fatigue characteristics used for an extra fine steel wire of high strength and high ductility which is used for a steel cord, a belt cord, and the like for reinforcing rubber and organic materials such as those in tires, belts and hoses, and for a steel wire of high strength which is used for a rope, a PC (Prestressed Concrete) wire, and the like.

BACKGROUND OF THE INVENTION

In general, a drawn extra fine wire of high carbon steel used for a steel cord is usually produced by optionally hot rolling a steel material, cooling under control the hot rolled steel material to give a wire rod having a diameter of 4.0 to 5.5 mm, primary drawing the wire rod, final patenting the wire, plating the wire with brass, and finally wet drawing the wire. Such extra fine steel wires are in many cases stranded to give, for example, a two-strand cord or five-strand cord, which is used as a steel cord. These wires are required to have properties such as mentioned below:

a. a high strength, b. an excellent drawability at high speed, c. excellent fatigue characteristics, and d. excellent high speed stranding characteristics.

Accordingly, steel materials of high quality, in accordance with the demand, have heretofore been developed.

For example, Japanese Unexamined Patent Publication (Kokai) No. 60-204865 discloses the production of an extra fine wire and a high carbon steel wire rod for a steel cord which exhibit less breakage during stranding, and a high strength and a high ductility, by adjusting the Mn content to less than 0.3% to inhibit supercooled structure formation after lead patenting and controlling the amounts of elements such as C, Si and Mn. Moreover, Japanese Unexamined Patent Publication (Kokai) No. 63-24046 discloses a steel wire rod for a highly tough and ductile extra fine wire the lead patented wire of which rod is made to have a high tensile strength with a low working ratio of wire drawing by adjusting the Si content to at least 1.00%.

On the other hand, oxide type nonmetallic inclusions can be mentioned as one of factors which exert adverse effects on these properties.

Inclusions having a single composition such as $Al_2O_3$, $SiO_2$, CaO, $TiO_2$ and MgO are in general highly hard and nonductile, among oxide type inclusions. Accordingly, increasing the cleanliness of molten steel and making oxide type inclusions low-melting and soft are necessary for producing a high carbon steel wire rod excellent in drawability.

As methods for increasing the cleanliness of steel and making nonductile inclusions soft as mentioned above, Japanese Examined Patent Publication (Kokoku) No. 57-22969 discloses a method for producing a steel for a high carbon steel wire rod having good drawability, and Japanese Unexamined Patent Publication (Kokai) No. 55-24961 discloses a method for producing an extra fine steel wire. The fundamental idea of these techniques is the composition control of oxide type nonmetallic inclusions of the ternary system $Al_2O_3$—$SiO_2$—MnO.

On the other hand, Japanese Unexamined Patent Publication (Kokai) No. 50-71507 proposes an improvement of the drawability of steel wire products by locating nonmetallic inclusions thereof in the spessartite region in the ternary phase diagram of $Al_2O_3$, $SiO_2$ and MnO. Moreover, Japanese Unexamined Patent Publication (Kokai) No. 50-81907 discloses a method for improving the drawability of a steel wire by controlling the amount of Al to be added to molten steel to decrease harmful inclusions.

Furthermore, Japanese Examined Patent Publication (Kokoku) No. 57-35243 proposes, in relation to the production of a steel cord having a nonductile inclusion index up to 20, a method for making inclusions soft comprising the steps of blowing CaO-containing flux into a molten steel in a ladle together with a carrier gas (inert gas) under complete control of Al, predeoxidizing the molten steel, and blowing an alloy containing one or at least two of substances selected from Ca, Mg and REM.

However, a steel wire having an even higher strength, higher ductility and higher fatigue strength is desired.

DISCLOSURE OF THE INVENTION

The present invention has been achieved for the purpose of providing a steel wire rod and a steel wire having a high strength, a high ductility and an excellent fatigue characteristic that conventional steel wires have been unable to attain.

The subject matter of the present invention is as described below.

(1) A hot rolled steel wire rod of high strength comprising, by mass %, 0.7 to 1.1% of C, 0.1 to 1.5% of Si, 0.1 to 1.5% of Mn, up to 0.02% of P, up to 0.02% of S and the balance Fe and unavoidable impurities, and containing nonmetallic inclusions at least 80% of which comprise 4 to 60% of CaO+MnO, 22 to 87% of $SiO_2$ and 0 to 46% of $Al_2O_3$ and have melting points up to 1,500° C.

(2) A hot rolled steel wire rod of high strength comprising, by mass %, 0.7 to 1.1% of C, 0.1 to 1.5% of Si, 0.1 to 1.5% of Mn, up to 0.02% of P, up to 0.02% of S, up to 0.3% of Cr, up to 1.0% of Ni, up to 0.8% of Cu and the balance Fe and unavoidable impurities, and containing nonmetallic inclusions at least 80% of which comprise 4 to 60% of CaO+MnO, 22 to 87% of $SiO_2$ and 0 to 46% of $Al_2O_3$ and have melting points up to 1,500° C.

(3) The hot rolled steel wire rod of high strength according to (1) or (2), wherein the structure of the wire rod comprises at least 95% of a pearlitic structure.

(4) The hot rolled steel wire rod of high strength according to(1) or (2), wherein the structure of the wire rod comprises at least 70% of a bainitic structure.

(5) The hot rolled steel wire rod of high strength according to any of (1) to (4), wherein the wire rod has a tensile strength from at least 261+1,010×(C mass %)−140 MPa and up to 261+1,010×(C mass %)+240 MPa.

(6) A steel wire of high strength excellent in fatigue characteristics comprising, by mass %, 0.7 to 1.1% of C, 0.1 to 1.5% of Si, 0.1 to 1.5% of Mn, up to 0.02% of P, up to 0.02% of S and the balance Fe and unavoidable impurities, and containing nonmetallic inclusions at least 80% of which comprise 4 to 60% of CaO+MnO, 22 to 87% of $SiO_2$ and 0 to 46% of $Al_2O_3$ and have melting points up to 1,500° C., and at least 70% of which have aspect ratios of at least 10.

(7) A steel wire of high strength comprising, by mass %, 0.7 to 1.1% of C, 0.1 to 1.5% of Si, 0.1 to 1.5% of Mn, up to 0.02% of P, up to 0.02% of S, up to 0.3% of Cr, up to 1.0% of Ni, up to 0.8% of Cu and the balance Fe and unavoidable impurities, and containing nonmetallic inclusions at least 80% of which comprise 4 to 60% of CaO+MnO, 22 to 87% of $SiO_2$ and 0 to 46% of $Al_2O_3$ and have melting points up to 1,500° C., and at least 70% of which have aspect ratios of at least 10.

(8) The steel wire of high strength excellent in fatigue characteristics according to (6) or (7), wherein the structure of the wire comprises at least 95% of a pearlitic structure.

(9) The steel wire of high strength excellent in fatigue characteristics according to (6) or (7), wherein the structure of the wire comprises at least 70% of a bainitic structure.

BEST MODE FOR CARRYING OUT THE INVENTION

Figure 1:
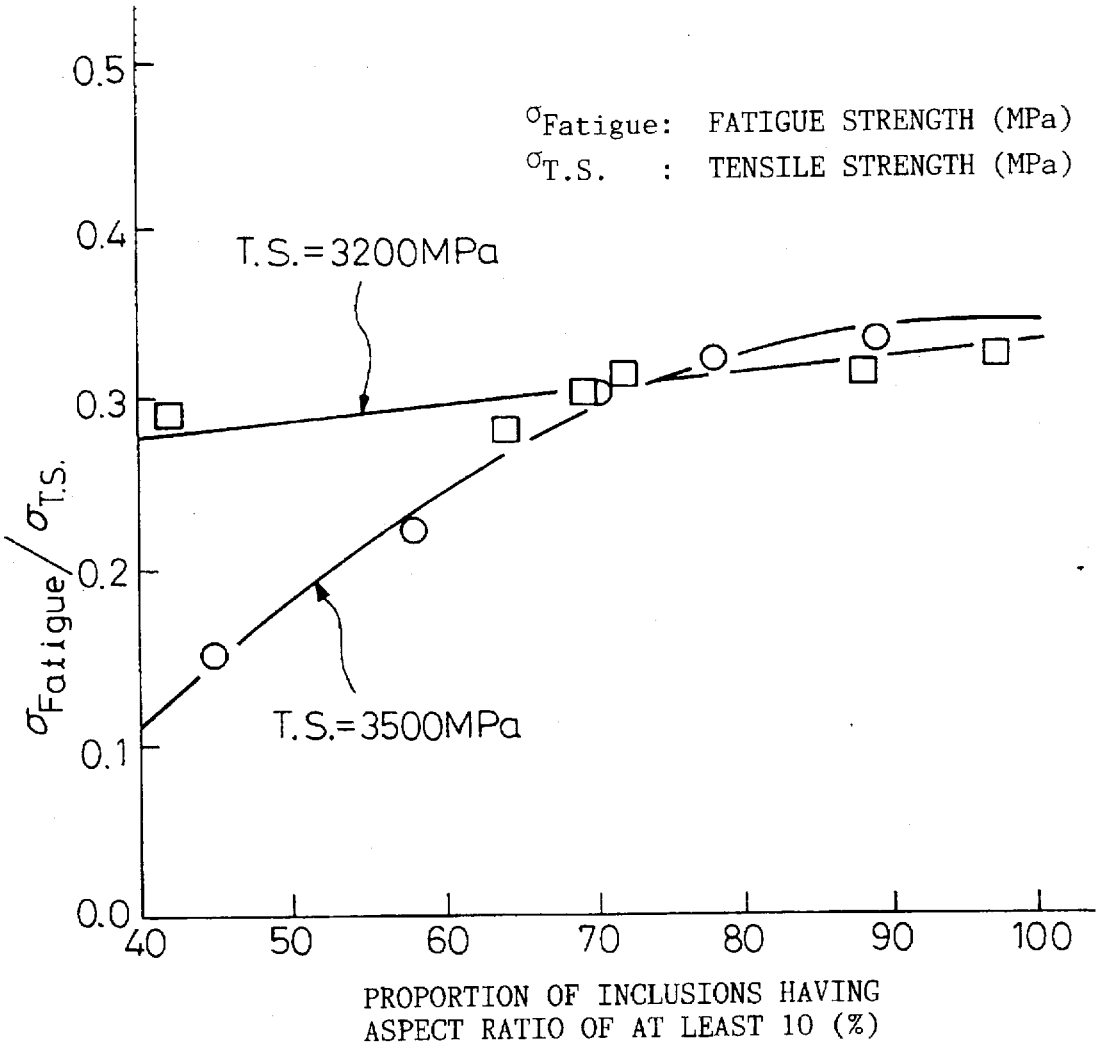
FIG. 1 is a graph showing the relationship between the proportion of nonmetallic inclusions having aspect ratios of at least 10 and the fatigue strength of a steel wire.

The present invention has been achieved on the basis of knowledge of nonmetallic inclusions which is utterly different from the conventional knowledge thereof. Nonmetallic inclusions having low melting points have heretofore been considered desirable as nonmetallic inclusions suited to a steel cast for a high carbon steel wire rod which is used for materials represented by a steel cord because such inclusions are recognized as capable of being elongated during the rolling of the steel wire rod. The consideration is based on the knowledge that nonmetallic inclusions of a low-melting point composition are generally plastically deformed at a temperature about half the melting point thereof. Nonmetallic inclusions have heretofore been considered to be deformed and made harmless by working during rolling so long as they simply have a low melting point. In contrast to the conventional knowledge, the present invention has been achieved on the basis of the knowledge described below.

In the production of a high carbon steel wire rod of the present invention for materials represented by a steel cord, $CaO—MnO—SiO_2—Al_2O_3$ type nonmetallic inclusions are inevitably formed by deoxidation and slag refining during steel-making. When the optimum region of the composition of nonmetallic inclusions are to be determined simply on the basis of the melting point of the inclusions, it is evident from the phase diagram in FIG. 4 that there are a plurality of regions where the inclusions have melting points of, for example, up to 1,400° C.

Though not shown in the phase diagram, in the low $SiO_2$ content region, in addition to the crystallization of $12CaO{\cdot}7Al_2O_3$ having a melting point of 1,455° C. as a primary phase, $CaO.Al_2O_3$ having a high melting point of 1,605° C. and $3CaO.Al_2O_3$ having a high melting point of 1,535° C. further emerge as precipitation phases. Accordingly, it is advantageous to select in the following manner the optimum composition of nonmetallic inclusions in a steel cast for a high carbon steel wire rod which is used for materials such as a steel cord: the composition is determined so that not only the average composition but also the compositions of such precipitation phases formed at the time of solidification have low melting points. The present invention has been achieved on the basis of a knowledge that the precipitated phases as well as the average composition should have low melting points, and that the composition of nonmetallic inclusions should be adjusted further from the compositions thus considered to a specified range.

Furthermore, the aspect ratio of nonmetallic inclusions in a steel wire rod and a steel wire has been paid attention to in the present invention on the condition that the nonmetallic inclusions as mentioned above are contained. As a result, nonmetallic inclusions having an aspect ratio of at least 4 in a steel wire rod and at least 10 in a drawn wire, that is, nonmetallic inclusions having extremely good workability have been realized for the first time, and the present invention has thus been achieved.

The reasons of restriction in the present invention will be explained in detail.

First, the reasons for restriction of the chemical composition and the nonmetallic inclusions in the present invention will be explained.

In addition, % shown below represents % by mass.

The reasons for restriction of the chemical composition of steel in the present invention are as described below.

C is an economical and effective strengthening element, and is also an element effective in lowering the precipitating amount of proeutectoid ferrite. Accordingly, a C content of at least 0.7% is necessary for enhancing the ductility of the steel as an extra fine steel wire having a tensile strength of at least 3,500 MPa. However, when the C content is excessively high, the ductility is lowered, and the drawability is deteriorated. The upper limit of the C content is, therefore, defined to be 1.1%.

Si is an element necessary for deoxidizing steel, and, therefore, the deoxidation effects become incomplete when the content is overly low. Moreover, although Si dissolves in the ferrite phase in pearlite formed after heat treatment to increase the strength of the steel after parenting, the ductility of ferrite is lowered and the ductility of the extra fine steel wire subsequent to drawing is lowered. Accordingly, the Si content is defined to be up to 1.5%.

To ensure the hardenability of the steel, the addition of Mn in a small amount is desirable. However, the addition of Mn in a large amount causes segregation, and supercooled structures of bainite and martensite are formed during patenting to deteriorate the drawability in subsequent drawing. Accordingly, the content of Mn is defined to be up to 1.5%.

When a hypereutectoid steel is treated as in the present invention, a network of cementite is likely to be formed in the structure subsequent to patenting and thick cementite is likely to be precipitated. For the purpose of realizing the high strength and high ductility of the steel, pearlite is required to be made fine, and such a cementite network and such thick cementite as mentioned above are required not to be formed. Cr is effective in inhibiting the emergence of such an extraordinary portion of cementite and in addition making pearlite fine. However, since the addition of Cr in a large amount increases the dislocation density in ferrite subsequent to heat treatment, the ductility of an extra fine steel wire subsequent to drawing is markedly impaired.

Accordingly, when Cr is added, the addition amount must be to such an extent that the addition effects can be expected. The addition amount is defined to be up to 0.3%, an amount which does not increase the dislocation density so that the ductility is not impaired.

Since Ni has the same effects as Cr, Ni is added, if the addition is decided, to such an amount that the effects can be expected. Since the addition of Ni in an excessive amount lowers the ductility of the ferrite phase, the upper limit is defined to be 1.0%.

Since Cu is an element for improving the corrosion fatigue characteristics of a steel wire rod, Cu is added, if the addition is decided, to such an amount that the effects can be expected. Since the addition of Cu in an excessive amount lowers the ductility of the ferrite phase, the upper limit is defined to be 0.8%.

Like a conventional extra fine steel wire, the content of S for ensuring the ductility is defined to be up to 0.02%. Since P is similar to S in that P impairs the ductility of a steel wire rod, the content of P is desirably defined to be up to 0.02%.

Reasons for restricting the composition of nonmetallic inclusions in the present invention will be explained.

It has heretofore been known that nonmetallic inclusions having a lower melting point in a steel wire are elongated more during working and are more effective in preventing wire breakage during drawing a steel wire rod.

However, the effects of nonmetallic inclusions on the fatigue characteristics of a steel cord, and the like which is used in an as drawn state have not been defined.

As the result of research, the present inventors have found that it is the presence of a crack near a nondeformable nonmetallic inclusion formed during wire drawing that causes significant deterioration of the fatigue characteristics. Accordingly, when the improvement of the fatigue characteristics of a drawn steel wire is considered, the nonmetallic inclusions contained in the cast steel must be made deformable.

Figure 4:
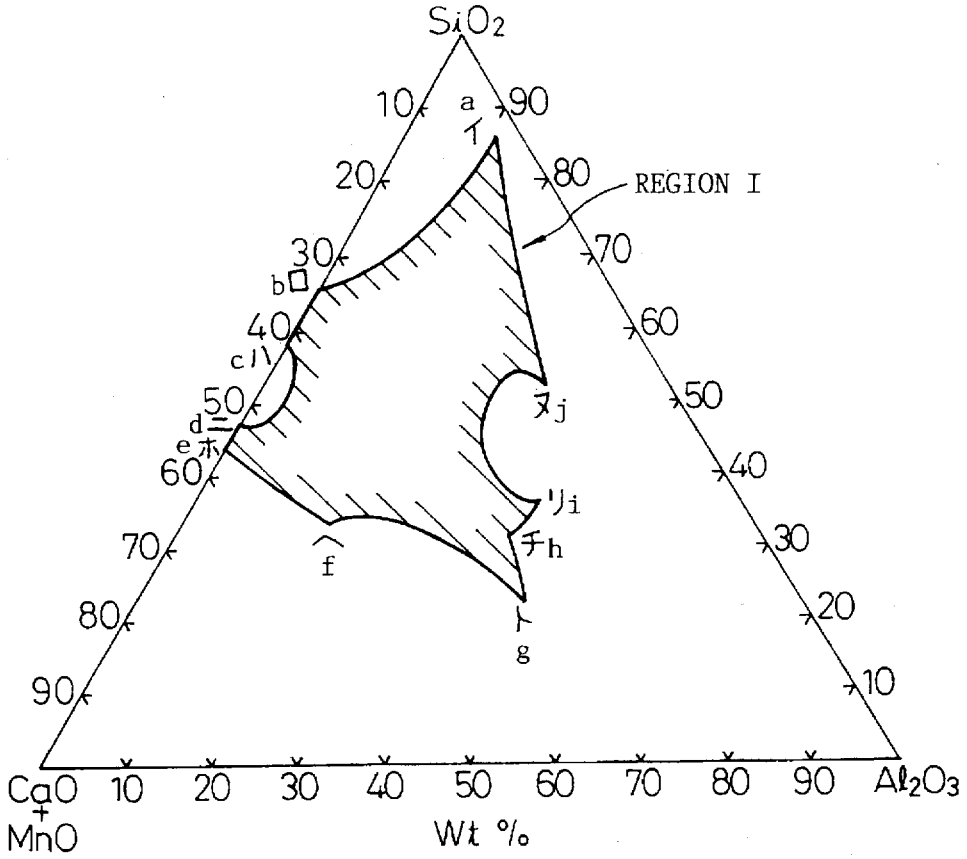
FIG. 4 is a diagram showing the optimum compositions of nonmetallic inclusions according to the present invention.
Figure 5:
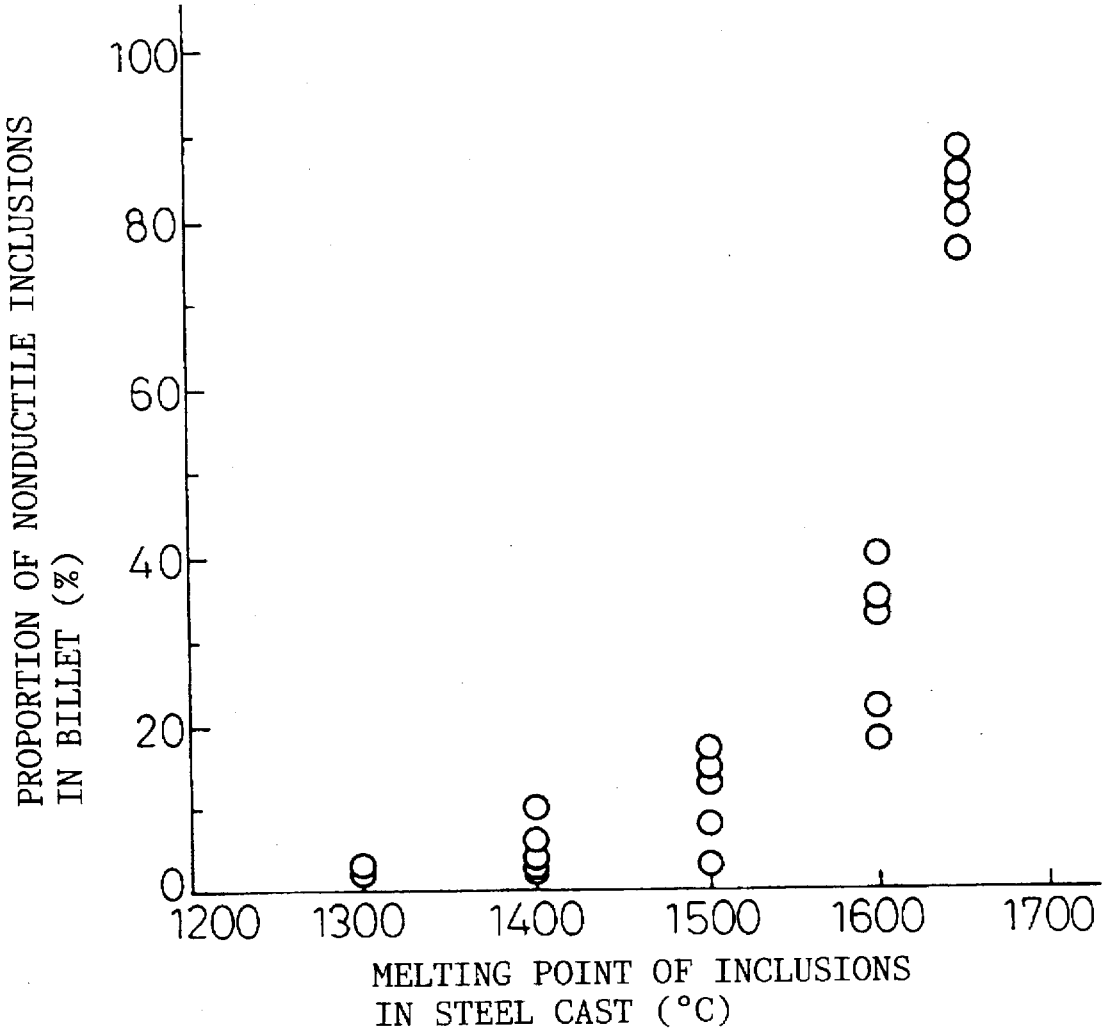
FIG. 5 is a graph showing the relationship between the melting point of nonmetallic inclusions in a steel and the amount of nonductile nonmetallic inclusions in a billet.

As shown in FIG. 5, when the nonmetallic inclusions in a cast steel are made to have a composition of the quasiternary system MnO+CaO, $SiO_2$ and $Al_2O_3$ so that the inclusions have a melting point up to 1,500° C., the proportion of nonmetallic inclusions which have been elongated after rolling the cast steel into a billet and during wire drawing is sharply increased. The ductility and fatigue characteristics of a drawn steel wire are improved by adjusting the composition of nonmetallic inclusions in the steel cast as described above. Accordingly, controlling the composition of nonmetallic inclusions in the steel cast or wire rod so that the composition is located in Region I enclosed by the letters a, b, c, d, e, f, g, h, i and j in FIG. 4 is effective in increasing the amount of ductile nonmetallic inclusions.

Figure 6:
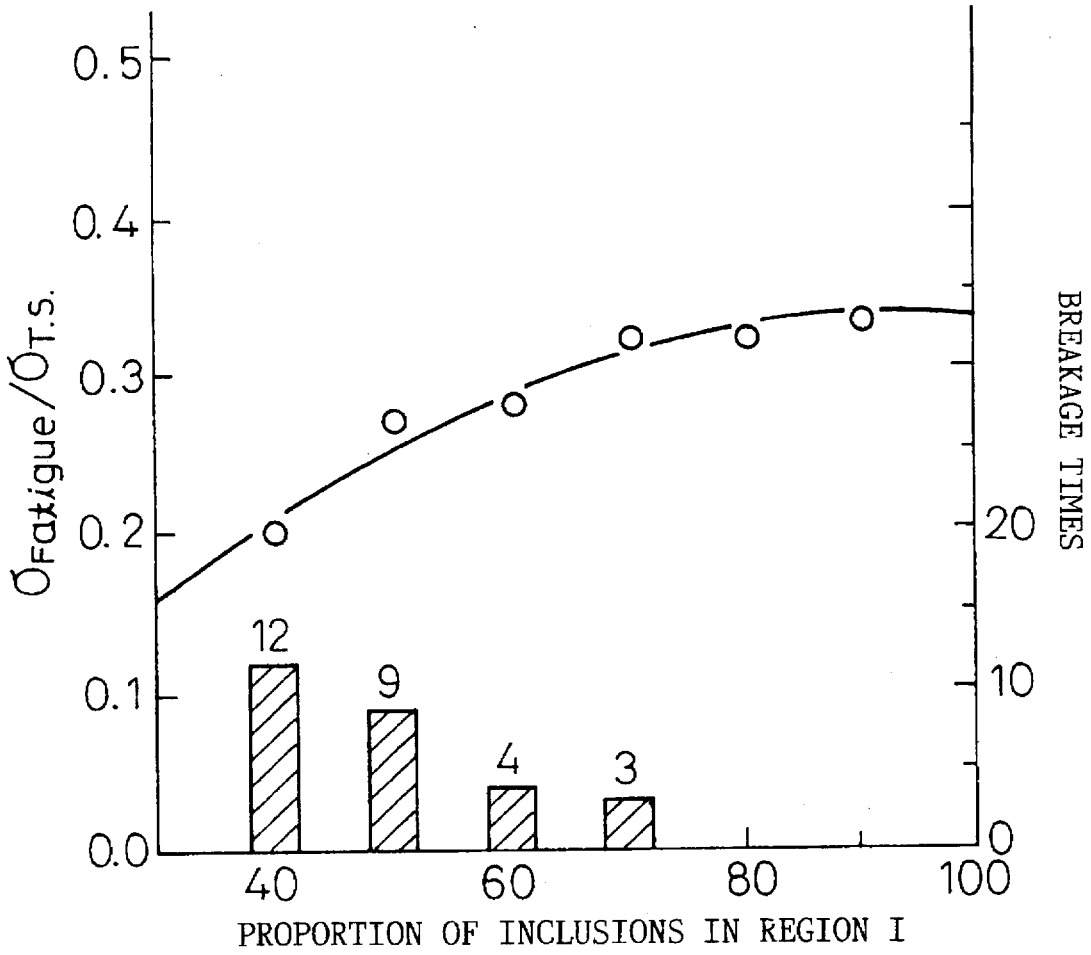
FIG. 6 is a graph showing the relationship between the optimum proportion of nonmetallic inclusions, and the wire drawability and fatigue characteristics.

In FIG. 4, there is a region adjacent to Region I in which region nonmetallic inclusions have melting points up to 1,500° C. However, though not shown in the phase diagram, in the low $SiO_2$ content region, in addition to the crystallization of $12CaO.7Al_2O_3$ as a primary phase having a melting point of 1,455° C., $CaO.Al_2O_3$ having a melting point of 1,605° C. and $3CaO.Al_2O_3$ having a melting point of 1,535° C. further precipitate at the time of solidification, high-melting point phases which are hard and cause breakage during wire drawing. Accordingly, the low $SiO_2$ region is not preferred. As the result of research, the present inventors have discovered, as shown in FIG. 6, that the fatigue characteristics are improved as the proportion of nonmetallic inclusions the compositions of which are located in Region I in FIG. 4 increases, and that the improvement in the fatigue characteristics is approximately saturated when the proportion thereof approaches near 80%. Accordingly, at least 80% of the nonmetallic inclusions counted are required to be located in Region I in FIG. 4.

Furthermore, the present inventors have paid attention to the form of inclusions in a wire prepared by drawing, thought of inhibiting the formation of a crack near a nonmetallic inclusion which crack causes the deterioration of wire fatigue characteristics. Fatigue characteristics of steel wire are improved by making a nonmetallic inclusion which has an elongated shape in longitudinal direction of the steel wire. Because stress concentration at the tip of a crack originated from the nonmetallic inclusion is released. FIG. 1 shows the relationship between the proportion of nonmetallic inclusions having aspect ratios of at least 10 in a steel wire and fatigue characteristics (a value obtained by dividing a fatigue strength obtained by Hunter fatigue test by a tensile strength). As shown in FIG. 1, the fatigue strength of steel wires having the same wire strength increases with the proportion of inclusions therein having aspect ratios of at least 10, and is approximately saturated when the proportion becomes at least 70%. Accordingly, the aspect ratios of at least 70% of inclusions in the wire are defined to be at least 10.

Figure 2:
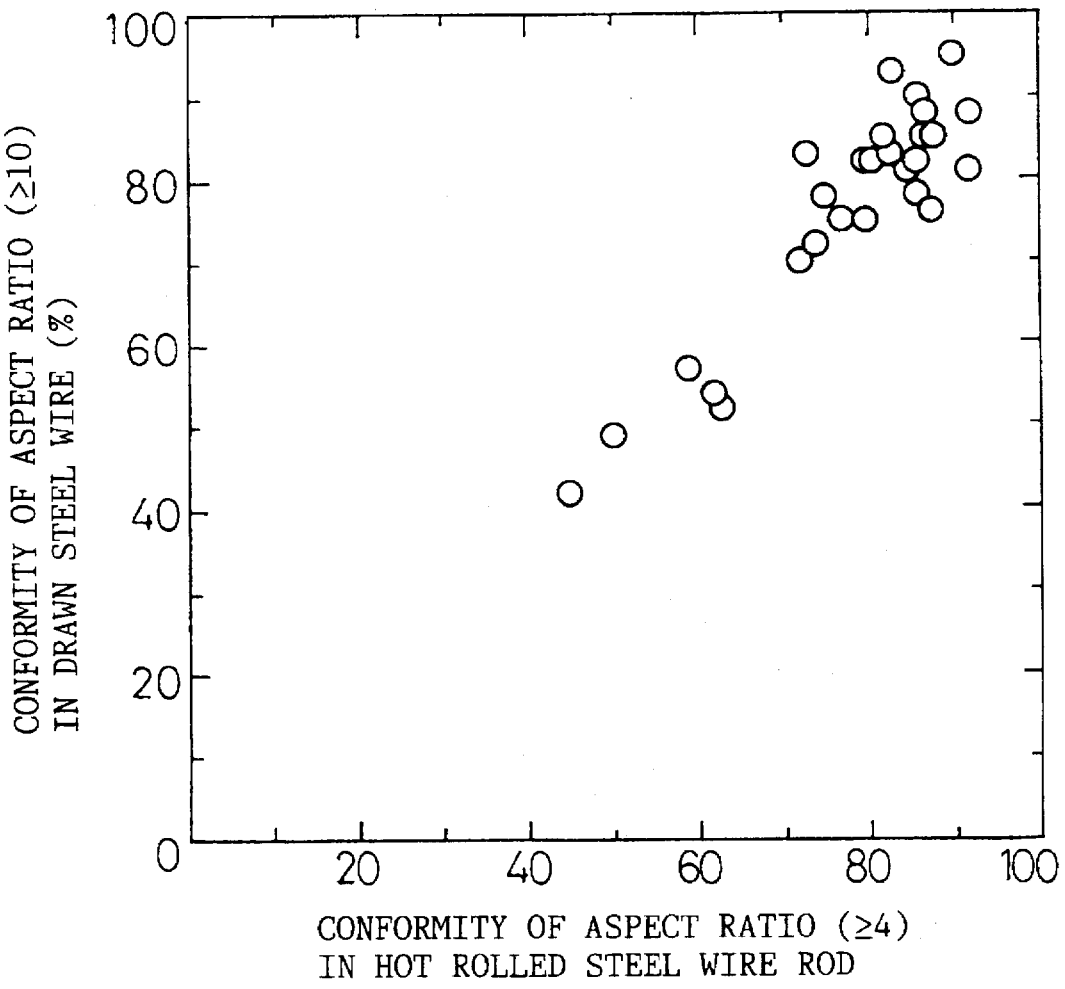
FIG. 2 is a graph showing the relationship between the form of nonmetallic inclusions in a hot rolled steel wire rod and the form thereof in a drawn wire

It can be seen from FIG. 2 that, in order to make nonmetallic inclusions have aspect ratios of at least 10 during wire drawing, the aspect ratios of the inclusions during hot rolling should be adjusted to at least 4.

Figure 3:
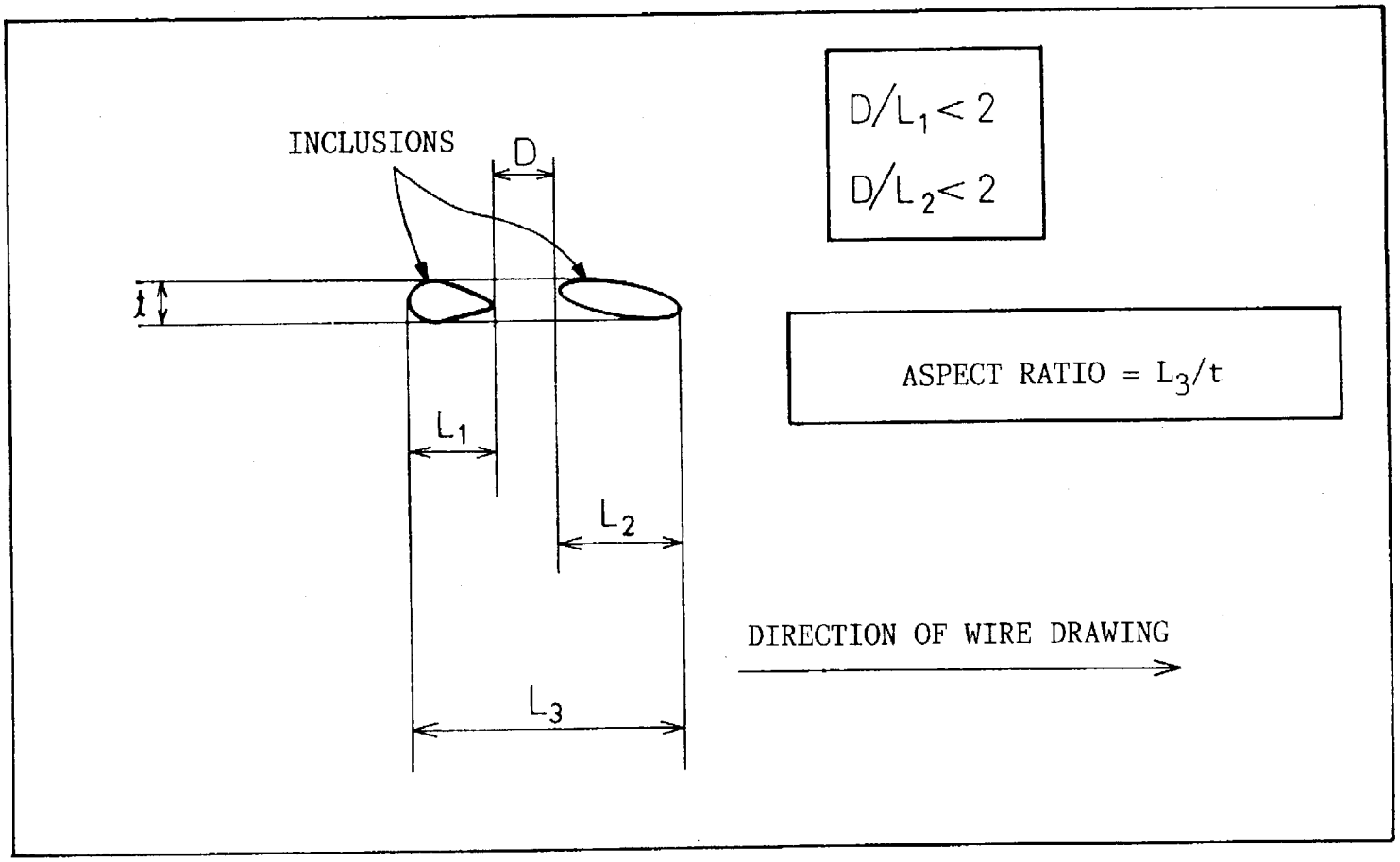
FIG. 3 is a view showing a method for measuring an aspect ratio of nonmetallic inclusions.

As shown in FIG. 3, in the case where there is an inclusion having a length L in the drawing direction and where there is another inclusion within a distance 2 L, the aspect ratio is determined on the assumption that the two inclusions are connected.

Furthermore, in FIG. 1 mentioned above, such effects of the shape of inclusions as mentioned above become particularly significant when the tensile strength is at least 2,800–1,200 log D (MPa, wherein D represents a circle-equivalent wire diameter), and, therefore, the tensile strength is preferably at least 2,800–1,200 log D.

For the purpose of improving the fatigue characteristics of a hot rolled steel material, the structure is required to comprise at least 95% of a pearlitic structure. When the tensile strength is less than TS wherein TS=261+1,010×(C mass %)−140 MPa, the effects of elongating inclusions during wire drawing become insignificant. When the tensile strength exceeds TS wherein TS=261+1,010×(C mass %)+240 MPa, it becomes difficult to make the structure comprise at least 95% of a pearlitic structure. Accordingly, when the structure comprises a pearlitic structure, the tensile strength is defined to be as follows:

at least 261+1,010×(C mass %)−140 MPa and up to 261+1,010×(C mass %)+240 MPa

In the case where the structure of the steel subsequent to hot rolling is made to comprise a bainitic structure, the structure is required to comprise at least 70% of a bainitic structure for the purpose of improving the fatigue characteristics.

The production process of the present invention will be explained.

A steel having such a chemical composition as mentioned above and containing nonmetallic inclusions in the range as mentioned above of the present invention is hot rolled to give a wire rod having a diameter of at least 4.0 mm and up to 7.0 mm. The wire diameter is a equivalent circular diameter, and the actual cross sectional shape may be any of a polygon such as a circle, an ellipsoid and a triangle. When the wire diameter is determined to be less than 4.0 mm, the productivity is markedly lowered. Moreover, when the wire diameter exceeds 7.0 mm, a sufficient cooling rate cannot be obtained in controlled cooling. Accordingly, the wire diameter is defined to be up to 7.0 mm.

Such a hot rolled steel wire rod is drawn to give a steel wire having a wire diameter of 1.1 to 2.7 mm. When the wire diameter is determined to be up to 1.0 mm, cracks are formed in the drawn wire. Since the cracks exert adverse effects on subsequent working, the wire diameter is defined to be at least 1.1 mm. Moreover, when the drawn steel wire has a diameter of at least 2.7 mm, good results with regard to the ductility of the steel wire cannot be obtained after wire drawing in the case where the wire diameter of a final product is determined to be up to 0.4 mm. The diameter of the steel wire prior to final patenting is, therefore, defined to be up to 2.7 mm. At this time, wire drawing may be conducted either by drawing or by roller dieing.

A steel wire the tensile strength of which is adjusted to (530+980×C mass %) MPa by parenting exhibits the most excellent strength-ductility balance when the wire is worked to have a true strain of at least 3.4 and up to 4.2. When the steel wire has a tensile strength up to {(530+980×C mass %)−50} MPa, a sufficient tensile strength cannot be obtained after wire drawing. When the steel wire has a tensile strength of at least {(530+980×C mass %)+50} MPa, a bainitic structure emerges in a pearlitic structure in a large amount though the steel wire has a high strength. Consequently, the following disadvantages result: the work hardening ratio is lowered during wire drawing and the attained strength is lowered in the same reduction of area, and the ductility is also lowered. Accordingly, the tensile strength of the steel wire is required to be adjusted to within {(530+980×C mass %)±50} MPa by patenting.

The steel wire is produced either by dry drawing or by wet drawing, or by a combination of these methods. To make the die wear as small as possible during wire drawing, the wire is desirably plated. Although plating such as brass plating, Cu plating and Ni plating is preferred in view of an economical advantage, another plating procedure may also be applied.

When the steel wire is wet dram to have a true strain of at least (−1.43×log D+3.09), the strength becomes excessively high, and as a result the fatigue characteristics are deteriorated. When the steel wire is wet drawn to have a true strain up to (−1.43×log D+2.49), a strength of at least 3,500 MPa cannot be obtained When the tensile strength of the steel wire exceeds (−1,590×log D+3,330), the steel wire is embrittled, and is difficult to work further. Accordingly, the tensile strength of the steel wire is required to be adjusted to up to (−1,590×log D+3,330).

When a steel wire having a equivalent circular diameter of 0.15 to 0.4 mm is produced by the production steps as mentioned above, the steel wire thus obtained has a ductility sufficient to resist twist during subsequent stranding in many cases. Accordingly, it becomes possible to produce a single wire steel cord or a multi-strand steel cord having excellent fatigue characteristics.

Furthermore, when the steel wire is wet drawn to have a true strain of at least (−1.23×log D+4.00), the strength becomes excessively high, and as a result the fatigue characteristics are deteriorated.

When the steel wire is wet drawn to have a true strain up to (−1.23×log D+3.00), a strength of at least 4,000 MPa cannot be obtained A steel wire having a long fatigue life can be produced by producing a wire having a equivalent circular diameter of 0.02 to 0.15 mm by the production steps.

The present invention will be illustrated more in detail on the basis of examples.

EXAMPLES

Example 1

A molten steel was tapped from a LD converter, and subjected to chemical composition adjustment to have a molten steel chemical composition as listed in Table 1 by secondary refining. The molten steel was cast into a steel cast having a size of 300×500 mm by continuous casting.

TABLE 1

| | Chemical composition (mass %) | | | | | | | | | Conformity of inclusion compsn.* |
|---|---|---|---|---|---|---|---|---|---|---|
| | C | Si | Mn | Cr | Ni | Cu | P | S | Al | (%) |
| Steel of invention | | | | | | | | | | |
| 1 | 0.92 | 0.20 | 0.33 | 0.22 | — | — | 0.010 | 0.003 | 0.001 | 84 |
| 2 | 0.92 | 0.39 | 0.48 | 0.19 | — | — | 0.008 | 0.004 | 0.001 | 100 |
| 3 | 0.96 | 0.19 | 0.32 | 0.21 | — | — | 0.009 | 0.003 | 0.002 | 95 |
| 4 | 0.96 | 0.19 | 0.32 | 0.21 | — | — | 0.009 | 0.003 | 0.002 | 80 |
| 5 | 0.96 | 0.19 | 0.32 | 0.10 | 0.80 | — | 0.005 | 0.006 | 0.001 | 83 |
| 6 | 0.98 | 0.30 | 0.32 | — | — | 0.20 | 0.007 | 0.005 | 0.002 | 96 |
| 7 | 0.98 | 0.20 | 0.31 | — | — | 0.80 | 0.006 | 0.005 | 0.002 | 98 |
| 8 | 1.02 | 0.21 | 0.20 | 0.10 | 0.10 | — | 0.008 | 0.003 | 0.002 | 100 |
| 9 | 1.02 | 0.21 | 0.20 | — | 0.10 | 0.10 | 0.007 | 0.003 | 0.002 | 88 |
| 10 | 1.06 | 0.19 | 0.31 | — | 0.10 | — | 0.007 | 0.004 | 0.002 | 86 |
| 11 | 1.06 | 0.19 | 0.31 | 0.15 | — | — | 0.008 | 0.003 | 0.002 | 93 |
| 12 | 1.06 | 0.19 | 0.31 | 0.15 | — | — | 0.008 | 0.003 | 0.002 | 93 |
| Steel of invention | | | | | | | | | | |
| 13 | 0.82 | 0.21 | 0.50 | — | — | — | 0.009 | 0.003 | 0.002 | 87 |
| Comp. steel | | | | | | | | | | |
| 14 | 0.96 | 0.19 | 0.32 | 0.21 | — | — | 0.009 | 0.003 | 0.002 | 66 |

TABLE 1-continued

| | Chemical composition (mass %) | | | | | | | | | Conformity of inclusion compsn.* |
|---|---|---|---|---|---|---|---|---|---|---|
| | C | Si | Mn | Cr | Ni | Cu | P | S | Al | (%) |
| 15 | 0.96 | 0.19 | 0.32 | 0.21 | — | — | 0.009 | 0.003 | 0.002 | 84 |
| 16 | 0.96 | 0.19 | 0.32 | 0.21 | — | — | 0.009 | 0.003 | 0.002 | 84 |
| 17 | 0.96 | 0.19 | 0.32 | 0.21 | — | — | 0.009 | 0.003 | 0.002 | 84 |

Note:
*compsn. = composition

The steel slab was further rolled to give a billet. The billet was hot rolled, and subjected to controlled cooling to give a wire rod having a diameter of 5.5 mm. Cooling control was conducted by stalemore cooling.

The steel wire rod thus obtained was subjected to wire drawing and intermediate parenting to give a steel wire having a diameter of 1.2 to 2.0 mm (see Tables 2 and 3).

TABLE 2

| | Wire dia. (mm) | Proeutectoid cementite | Steps | Diameter of heat treated wire (mm) |
|---|---|---|---|---|
| Steel of invention | | | | |
| 1 | 4.0 | No | 4.0→3.25(LP)→1.40(LP)→0.30(LP)→0.020 | 0.30 |
| 2 | 5.5 | No | 5.5→3.25(LP)→0.80(LP)→0.062 | 0.80 |
| 3 | 5.5 | No | 5.5→3.25(LP)→0.74(LP)→0.062 | 0.74 |
| 4 | 7.0 | No | 7.0→3.25(LP)→0.80(LP)→0.062 | 0.80 |
| 5 | 5.5 | No | 5.5→3.25(LP)→1.20(LP)→0.100 | 1.20 |
| 6 | 5.0 | No | 5.0→3.25(LP)→0.90(LP)→0.080 | 0.90 |
| 7 | 5.5 | No | 5.5→3.25(LP)→1.00(LP)→0.080 | 1.00 |
| 8 | 5.5 | No | 5.5→3.25(LP)→0.74(LP)→0.080 | 0.74 |
| 9 | 5.5 | No | 5.5→3.25(LP)→0.80(LP)→0.062 | 0.80 |
| 10 | 5.5 | No | 5.5→3.25(LP)→0.90(LP)→0.080 | 0.90 |
| 11 | 5.5 | No | 5.5→3.25(LP)→0.60(LP)→0.080 | 0.60 |
| 12 | 5.5 | No | 5.5→3.25(LP)→0.60(LP)→0.080 | 0.60 |
| Steel of invention | | | | |
| 13 | 5.5 | No | 5.5→3.25(LP)→0.74(LP)→0.062 | 0.74 |
| Comp. steel | | | | |
| 14 | 5.5 | No | 5.5→3.25(LP)→0.74(LP)→0.062 | 0.74 |
| 15 | 5.5 | Yes | 5.5→3.25(LP)→0.74(LP)→0.062 | 0.74 |
| 16 | 5.5 | No | 5.5→3.25(LP)→0.74(LP)→0.062 | 0.74 |
| 17 | 5.5 | No | 5.5→3.25(LP)→1.00(LP)→0.062 | 1.00 |

TABLE 3

| | Wire dia. (mm) | Tensile strength of patented wire (MPa) | Plating treatment | Final wire dia. (mm) | reduction of area $\epsilon = 2\ln(D_0/D)$ | Number of wire breakage |
|---|---|---|---|---|---|---|
| Steel of invention | | | | | | |
| 1 | 4.0 | 1450 | Brass plating | 0.020 | 5.42 | 0 |
| 2 | 5.5 | 1454 | Brass plating | 0.062 | 5.11 | 0 |
| 3 | 5.5 | 1460 | Brass plating | 0.062 | 4.96 | 0 |
| 4 | 7.0 | 1465 | Brass plating | 0.062 | 5.11 | 0 |
| 5 | 5.5 | 1491 | Brass plating | 0.100 | 4.97 | 0 |
| 6 | 5.0 | 1491 | Brass plating | 0.080 | 4.84 | 0 |
| 7 | 5.5 | 1521 | Brass plating | 0.080 | 5.05 | 0 |
| 8 | 5.5 | 1530 | Brass plating | 0.080 | 4.45 | 0 |
| 9 | 5.5 | 1572 | Copper plating | 0.062 | 5.11 | 0 |
| 10 | 5.5 | 1590 | Nickel plating | 0.080 | 4.84 | 0 |
| 11 | 5.5 | 1528 | Brass plating | 0.080 | 4.03 | 0 |

TABLE 3-continued

| | Wire dia. (mm) | Tensile strength of patented wire (MPa) | Plating treatment | Final wire dia. (mm) | reduction of area $\epsilon = 2\ln(D_0/D)$ | Number of wire breakage |
|---|---|---|---|---|---|---|
| 12 Steel of invention | 5.5 | 1528 | Brass plating | 0.080 | 4.03 | 0 |
| 13 Comp. steel | 5.5 | 1310 | Brass plating | 0.062 | 4.96 | 0 |
| 14 | 5.5 | 1460 | Brass plating | 0.062 | 4.96 | 3 |
| 15 | 5.5 | 1460 | Brass plating | 0.062 | 4.96 | 20↑ |
| 16 | 5.5 | 1534 | Brass plating | 0.062 | 4.96 | 5 |
| 17 | 5.5 | 1460 | Brass plating | 0.062 | 5.56 | 7 |

The steel wire thus obtained was heated to 900° C., subjected to final patenting in a temperature range from 550° to 600° C. so that the structure and the tensile strength were adjusted, plated with brass, and subjected to final wet wire drawing. Tables 2 and 3 show a wire diameter at the time of patenting, a tensile strength subsequent to patenting and a final wire diameter subsequent to wire drawing in the production of each of the steel wires.

The characteristics of the steel wire were evaluated by a tensile test, a twisting test and a fatigue test.

TABLE 4

| | Tensile strength (MPa) | Reduction of area (%) | Fatigue characteristics |
|---|---|---|---|
| Steel of invention | | | |
| 1 | 5684 | 34.0 | ○ |
| 2 | 4870 | 32.6 | ○ |
| 3 | 5047 | 38.4 | ○ |
| 4 | 5174 | 31.5 | ○ |
| 5 | 5124 | 32.5 | ○ |
| 6 | 4560 | 36.0 | ○ |
| 7 | 4964 | 33.8 | ○ |
| 8 | 4672 | 36.8 | ⊕ |
| 9 | 5324 | 38.4 | ○ |
| 10 | 4870 | 36.4 | ⊕ |
| 11 | 4125 | 40.1 | ○ |
| 12 | 4205 | 42.1 | ⊕ |
| 13 | 3875 | 35.8 | ○ |
| Comp. steel | | | |
| 14 | 5037 | 35.0 | x |
| 15 | — | — | — |
| 16 | 4939 | 38.0 | x |
| 17 | 5320 | 18.4 | x |

The fatigue characteristics of the steel wire listed in Table 4 were evaluated by measuring the fatigue strength of the wire by a Hunter fatigue test, and represented as follows: ⊕: the fatigue strength was at lest 0.33 times as much as the tensile strength, o: the fatigue strength was at least 0.3 times as much as the tensile strength, and x: the fatigue strength was less than 0.3 times as much as the tensile strength. Moreover, the fatigue strength was measured by using a Hunter fatigue test, and a strength under which the wire was not ruptured in a cyclic fatigue test with a number of repeating cycles of up to $10^6$ was defined as a fatigue strength.

Steels 1 to 13 in the table are steels of the present invention, and steels 14 to 17 are comparative steels.

Comparative steel 14 had a chemical composition within the scope of the present invention. However, the conformity of the nonmetallic inclusions in the steel cast was low compared with that of the present invention. The process for producing a steel wire was the same as that of the present invention except for the conformity thereof.

Comparative steel 15 had the same chemical composition and the same composition of nonmetallic inclusions as those of the present invention, and primary cementite emerged in controlled cooling subsequent to hot rolling.

Comparative steel 16 had the same chemical composition and the same composition of nonmetallic inclusions as those of the present invention. However, the tensile strength of the finally patented steel wire exceeded the tensile strength in the scope of the claims of the present invention.

Comparative steel 17 had the same chemical composition and the same composition of nonmetallic inclusions as those of the present invention. However, the reduction of area in wire drawing subsequent to final parenting was larger than that of the present invention.

In Comparative steel 14, although the strength of at least 4,000 MPa was obtained, the composition of nonmetallic inclusions in the steel cast differed from that of the steel of the present invention. As a result, the number of wire breakages was large, and good fatigue characteristics could not be obtained.

In Comparative steel 15, since primary cementite emerged after hot rolling, the final wire could not be produced.

In Comparative steel 16, since the tensile strength obtained after final patenting was excessively high, the fatigue characteristics of the final wire were deteriorated, and good results could not be obtained.

In Comparative steel 17, since the reduction of area became excessively high in final wet wire drawing, the fatigue characteristics of the final steel wire were deteriorated, and good results could not be obtained.

Example 2

Table 5 lists the chemical compositions of steel wires of the present invention and those of comparative steel wires.

TABLE 5

| | Chemical composition (mass %) | | | | | | | | |
|---|---|---|---|---|---|---|---|---|---|
| | C | Si | Mn | Cr | Ni | Cu | P | S | Al |
| Steel of Invention | | | | | | | | | |
| 18 | 0.72 | 0.20 | 0.49 | — | — | — | 0.012 | 0.008 | 0.001 |
| 19 | 0.82 | 0.20 | 0.49 | — | — | — | 0.015 | 0.007 | 0.001 |
| 20 | 0.82 | 0.20 | 0.33 | 0.20 | — | — | 0.010 | 0.006 | 0.001 |
| 21 | 0.82 | 0.20 | 0.30 | 0.10 | 0.05 | 0.05 | 0.011 | 0.010 | 0.001 |
| 22 | 0.87 | 0.20 | 0.30 | 0.10 | — | 0.10 | 0.012 | 0.008 | 0.001 |
| 23 | 0.98 | 1.20 | 0.30 | 0.20 | — | — | 0.016 | 0.008 | 0.002 |
| 24 | 0.82 | 1.00 | 0.80 | — | — | — | 0.014 | 0.006 | 0.001 |
| 25 | 0.87 | 0.49 | 0.33 | 0.28 | — | — | 0.011 | 0.009 | 0.001 |
| 26 | 0.92 | 0.20 | 0.30 | 0.22 | — | 0.22 | 0.012 | 0.007 | 0.001 |
| 27 | 0.92 | 0.30 | 0.20 | 0.25 | — | — | 0.012 | 0.008 | 0.001 |
| 28 | 0.92 | 0.20 | 0.33 | 0.22 | — | — | 0.014 | 0.003 | 0.001 |
| 29 | 0.92 | 0.39 | 0.48 | 0.40 | — | — | 0.008 | 0.004 | 0.001 |
| 30 | 0.96 | 0.19 | 0.32 | — | 0.80 | — | 0.009 | 0.003 | 0.002 |
| 31 | 0.96 | 0.19 | 0.31 | 0.21 | — | | 0.006 | 0.005 | 0.002 |
| 32 | 0.98 | 0.30 | 0.32 | — | — | 0.20 | 0.007 | 0.005 | 0.002 |
| 33 | 0.98 | 0.20 | 0.31 | — | — | 0.80 | 0.006 | 0.005 | 0.002 |
| 34 | 1.02 | 0.21 | 0.20 | 0.10 | 0.10 | — | 0.008 | 0.003 | 0.002 |

TABLE 5-continued

| | Chemical composition (mass %) | | | | | | | | |
|---|---|---|---|---|---|---|---|---|---|
| | C | Si | Mn | Cr | Ni | Cu | P | S | Al |
| 35 | 1.02 | 0.21 | 0.20 | — | 0.10 | 0.10 | 0.007 | 0.003 | 0.002 |
| 36 | 1.06 | 0.19 | 0.31 | — | 0.10 | — | 0.007 | 0.004 | 0.002 |
| 37 | 1.06 | 0.19 | 0.31 | 0.15 | — | — | 0.008 | 0.003 | 0.002 |
| 38 | 0.98 | 1.20 | 0.30 | 0.20 | — | — | 0.012 | 0.005 | 0.001 |
| 39 | 0.98 | 1.20 | 0.30 | 0.20 | — | — | 0.013 | 0.006 | 0.001 |
| Comp. steel | | | | | | | | | |
| 40 | 0.82 | 0.21 | 0.50 | — | — | — | 0.009 | 0.003 | 0.002 |
| 41 | 0.92 | 0.20 | 0.33 | 0.22 | — | — | 0.010 | 0.003 | 0.001 |
| 42 | 0.92 | 0.20 | 0.33 | 0.22 | — | — | 0.010 | 0.003 | 0.001 |
| 43 | 0.92 | 0.20 | 0.33 | 0.22 | — | — | 0.010 | 0.003 | 0.001 |
| 44 | 0.92 | 0.20 | 0.33 | 0.22 | — | — | 0.010 | 0.003 | 0.001 |

A steel wire rod having a chemical composition as shown in Table 5 was drawn and patented by the steps as shown in Tables 6 and 7 to give a wire having a diameter of 0.02 to 4.0 mm.

TABLE 6

| | Wire dia. (mm) | Structure of hot rolled steel wire rod | Proportion of structure (%) | Tensile strength of hot rolled steel wire rod (MPa) | Conformity of aspect ratio (%) |
|---|---|---|---|---|---|
| Steel of invention | | | | | |
| 18 | 5.5 | Pearlitic | 98 | 1096 | 72 |
| 19 | 5.5 | Pearlitic | 97 | 1190 | 80 |
| 20 | 5.5 | Pearlitic | 96 | 1217 | 90 |
| 21 | 5.5 | Pearlitic | 97 | 1220 | 77 |
| 22 | 5.5 | Pearlitic | 96 | 1369 | 87 |
| 23 | 5.5 | Pearlitic | 98 | 1404 | 74 |
| 24 | 5.5 | Pearlitic | 96 | 1289 | 75 |
| 25 | 5.5 | Pearlitic | 95 | 1046 | 81 |
| 26 | 5.5 | Pearlitic | 97 | 1290 | 83 |
| 27 | 5.5 | Bainitic | 92 | 1390 | 88 |
| 28 | 4.0 | Bainitic | 78 | 1412 | 80 |
| 29 | 5.5 | Pearlitic | 95 | 1210 | 85 |
| 30 | 5.5 | Pearlitic | 93 | 1245 | 83 |
| 31 | 7.0 | Pearlitic | 96 | 1268 | 92 |
| 32 | 5.5 | Pearlitic | 97 | 1298 | 86 |
| 33 | 5.5 | Pearlitic | 98 | 1221 | 82 |
| 34 | 5.5 | Pearlitic | 99 | 1233 | 73 |
| 35 | 5.5 | Pearlitic | 100 | 1255 | 86 |
| 36 | 5.5 | Pearlitic | 100 | 1452 | 88 |
| 37 | 5.5 | Pearlitic | 100 | 1468 | 92 |
| 38 | 11.0 | Pearlitic | 98 | 1520 | 86 |
| 39 | 11.0 | Pearlitic | 96 | 1478 | 87 |
| Comp. steel | | | | | |
| 40 | 5.5 | Pearlitic | 95 | 1087 | 63 |
| 41 | 5.5 | Pearlitic | 96 | 1187 | 62 |
| 42 | 5.5 | Pearlitic | 98 | 1345 | 50 |
| 43 | 5.5 | Pearlitic | 98 | 1168 | 45 |
| 44 | 5.5 | Pearlitic | 97 | 1265 | 59 |

| | Steps |
|---|---|
| Steel of invention | |
| 18 | 5.5 → 2.00(LP) → 0.30 |
| 19 | 5.5 → 2.05(LP) → 0.30 |

TABLE 6-continued

| | |
|---|---|
| 20 | 5.5 → 1.95(LP) → 0.30 |
| 21 | 5.5 → 2.05(LP) → 0.30 |
| 22 | 5.5 → 2.00(LP) → 0.30 |
| 23 | 5.5 → 2.00(LP) → 0.30 |
| 24 | 5.5 → 2.00(LP) → 0.30 |
| 25 | 5.5 → 2.00(LP) → 0.30 |
| 26 | 5.5 → 1.90(LP) → 0.30 |
| 27 | 5.5 → 2.00(LP) → 0.30 |
| 28 | 4.0 → 1.40(LP) → 0.20 |
| 29 | 5.5 → 1.80(LP) → 0.30 |
| 30 | 5.5 → 3.25(LP) → 1.35(LP) → 0.20 |
| 31 | 7.0 → 3.5(LP) → 1:90(LP) → 0.30 |
| 32 | 5.0 → 3.25(LP) → 0.60(LP) → 0.02 |
| 33 | 5.5 → 3.25(LP) → 1.00(LP) → 0.08 |
| 34 | 5.5 → 1.80(LP) → 0.35 |
| 35 | 5.5 → 3.25(LP) → 1.10(LP) → 0.15 |
| 36 | 5.5 → 3.25(LP) → 1.15(LP) → 0.15 |
| 37 | 5.5 → 1.80(LP) → 0.40 |
| 38 | 11.0(DLP) → 4.0 |
| 39 | 13.0(DLP) → 5.0 |
| Comp. steel | |
| 40 | 5.5 -- 3.25(LP) -- 1.40(LP) -- 0.30 |
| 41 | 5.5 -- 3.25(LP) -- 1.70(LP) -- 0.30 |
| 42 | 5.5 -- 3.25(LP) -- 1.70(LP) -- 0.30 |
| 43 | 5.5 -- 3.25(LP) -- 1.70(LP) -- 0.30 |
| 44 | 5.5 -- 3.25(LP) -- 1.85(LP) -- 0.30 |

TABLE 7

| | Plating treatment | Final wire dia. (mm) | Conformity of aspect ratio (%) | Tensile strength (MPa) | Reduction of area (%) | Fatigue characteristics |
|---|---|---|---|---|---|---|
| Steel of invention | | | | | | |
| 18 | Brass P* | 0.30 | 70 | 3300 | 40.1 | o |
| 19 | Brass P* | 0.30 | 82 | 3680 | 30.1 | o |
| 20 | Brass P* | 0.30 | 95 | 3610 | 36.5 | o |
| 21 | Brass P* | 0.30 | 75 | 3870 | 34.8 | o |
| 22 | Brass P* | 0.30 | 85 | 3570 | 37.9 | o |
| 23 | Brass P* | 0.30 | 72 | 3980 | 39.5 | o |
| 24 | Brass P* | 0.30 | 78 | 3980 | 40.2 | o |
| 25 | Brass P* | 0.30 | 82 | 3930 | 36.7 | o |
| 26 | Brass P* | 0.30 | 83 | 4020 | 38.9 | o |
| 27 | Brass P* | 0.30 | 85 | 4080 | 40.2 | o |
| 28 | No P* | 0.20 | 75 | 4020 | 34.0 | o |
| 29 | No P* | 0.30 | 81 | 3824 | 32.6 | o |
| 30 | Brass P* | 0.20 | 93 | 4025 | 38.4 | o |
| 31 | Brass P* | 0.30 | 81 | 3980 | 31.5 | o |
| 32 | Brass P* | 0.02 | 90 | 5410 | 36.0 | o |
| 33 | Brass P* | 0.08 | 85 | 5120 | 33.8 | o |
| 34 | Brass P* | 0.35 | 83 | 3625 | 36.8 | o |
| 35 | Copper P* | 0.15 | 78 | 4220 | 38.4 | o |
| 36 | Nickel P* | 0.15 | 76 | 4310 | 36.4 | o |
| 37 | Brass P* | 0.40 | 88 | 3550 | 42.1 | o |
| 38 | No P* | 4.00 | 82 | 2357 | 38.0 | o |
| 39 | No P* | 5.00 | 88 | 2140 | 37.0 | o |
| Comp. steel | | | | | | |
| 40 | Brass P* | 0.30 | 52 | 3215 | 41.2 | x |
| 41 | No P* | 0.30 | 54 | 3674 | 35.0 | x |
| 42 | No P* | 0.30 | 49 | 3624 | 36.8 | x |
| 43 | Brass P* | 0.30 | 42 | 3633 | 38.0 | x |
| 44 | Brass P* | 0.30 | 57 | 4100 | 35.2 | x |

Note:
*P = plating

Table 6 lists the conformity of the aspect ratio of nonmetallic inclusions in a hot rolled steel wire rod used. Table 7 lists the conformity thereof in a final steel wire prepared according to the steps as shown in Table 6. It can be seen from the tables that when at least 70% of nonmetallic inclusions in any of hot rolled steel wire rods of the steels of invention 18 to 39 had aspect ratios of at least 4, there could be obtained nonmetallic inclusions in the final steel wire at least 70% of which inclusions had aspect ratios of at least 10 on the condition that the final steel wire had a tensile strength of at least 2,800–1,200×log D (MPa).

These steel wires were subjected to a fatigue test, and the results are shown in Table 7. When the steel wire diameter was up to 1 mm, the fatigue test was conducted using a Hunter fatigue testing machine. When the steel wire diameter exceeded 1 mm, the fatigue test was conducted using a Nakamura type fatigue testing machine. The fatigue limit thus obtained was divided by the tensile strength to give a value which was represented by the mark o when the value was at least 0.3 or by the mark x when the value was less than 0.3.

Steel wires of invention 18 to 39 were all adjusted within the scope of the present invention.

The forms of nonmetallic inclusions in Comparative steel wires 40 to 44 differed from those of the steel wires of the invention.

There could be obtained from the steels of invention steel wires having a tensile strength of at least 2,800–1,200 log D (MPa) and excellent fatigue characteristics. Although comparative steel wires had tensile strengths equivalent to those of the steel wires of invention, the fatigue characteristics were deteriorated compsteel wires of the steel wires of invention.

Example 3

A molten steel was tapped from a LD converter, and subjected to secondary refining so that the chemical composition of the steel was adjusted as shown in Table 8. The molten steel was cast into a steel cast having a size of 300×500 mm by continuous casting.

TABLE 8

| | Chemical composition (mass %) | | | | | | | | | Conformity of inclusion compsn.* |
|---|---|---|---|---|---|---|---|---|---|---|
| | C | Si | Mn | Cr | Ni | Cu | P | S | Al | (%) |
| Steel of invention | | | | | | | | | | |
| 45 | 0.92 | 0.20 | 0.33 | 0.22 | — | — | 0.010 | 0.003 | 0.001 | 84 |
| 46 | 0.92 | 0.39 | 0.48 | 0.10 | — | — | 0.008 | 0.004 | 0.001 | 100 |
| 47 | 0.96 | 0.19 | 0.32 | — | 0.80 | — | 0.009 | 0.003 | 0.002 | 95 |
| 48 | 0.96 | 0.19 | 0.32 | 0.21 | — | — | 0.006 | 0.005 | 0.002 | 80 |
| 49 | 0.98 | 0.30 | 0.32 | 0.15 | — | 9.20 | 0.007 | 0.005 | 0.002 | 96 |
| 50 | 0.98 | 0.20 | 0.31 | — | 0.20 | 0.80 | 0.006 | 0.005 | 0.002 | 98 |
| 51 | 1.02 | 0.21 | 0.20 | 0.10 | 0.10 | — | 0.008 | 0.003 | 0.002 | 100 |
| 52 | 1.02 | 0.21 | 0.20 | — | 0.10 | 0.10 | 0.007 | 0.003 | 0.002 | 88 |
| 53 | 1.06 | 0.19 | 0.31 | — | 0.10 | — | 0.007 | 0.004 | 0.002 | 86 |
| 54 | 1.06 | 0.19 | 0.31 | 0.15 | — | — | 0.007 | 0.003 | 0.002 | 93 |
| 55 | 1.06 | 0.19 | 0.31 | 0.15 | — | — | 0.008 | 0.003 | 0.002 | 93 |
| Comp. steel | | | | | | | | | | |
| 56 | 0.82 | 0.21 | 0.50 | — | — | — | 0.009 | 0.003 | 0.002 | 87 |
| 57 | 0.92 | 0.20 | 0.33 | 0.22 | — | — | 0.010 | 0.003 | 0.002 | 66 |
| 58 | 0.92 | 0.20 | 0.33 | 0.22 | — | — | 0.010 | 0.003 | 0.002 | 84 |
| 59 | 0.92 | 0.20 | 0.33 | 0.22 | — | — | 0.010 | 0.003 | 0.002 | 84 |
| 60 | 0.92 | 0.20 | 0.33 | 0.22 | — | — | 0.010 | 0.003 | 0.002 | 84 |

The steel slab was further bloomed to give a billet. The billet was hot rolled to give a steel wire rod having a diameter of 4.0 to 7.0 mm, which was subjected to controlled cooling. Cooling control was conducted by stalemore cooling.

The steel wire rod was subjected to wire drawing and intermediate parenting to give a wire having a diameter of 1.2 to 2.0 mm (see Tables 9 and 10).

TABLE 9

| | Wire dia. (mm) | Proeutectoid cementite | Steps | Dia. of heat treated wire (mm) |
|---|---|---|---|---|
| Steel of invention | | | | |
| 45 | 4.0 | No | 4.0 → 1.40(LP) → 0.20(LP) | 1.40 |
| 46 | 5.5 | No | 5.5 → 1.70(LP) → 0.30 | 1.70 |
| 47 | 5.5 | No | 5.5 → 3.25(LP) → 1.35(LP) → 0.20 | 1.35 |

TABLE 9-continued

| | Wire dia. (mm) | Proeutectoid cementite | Steps | Dia. of heat treated wire (mm) |
|---|---|---|---|---|
| 48 | 7.0 | No | 7.0 → 3.50(LP) → 1.90(LP) → 0.30 | 1.90 |
| 49 | 5.0 | No | 5.5 → 1.85(LP) → 0.30 | 1.85 |
| 50 | 5.5 | No | 5.0 → 3.25(LP) → 1.70(LP) → 0.35 | 1.70 |
| 51 | 5.5 | No | 5.5 → 1.80(LP) → 0.35 | 1.80 |
| 52 | 5.5 | No | 5.5 → 3.25(LP) → 1.10(LP) → 0.15 | 1.10 |
| 53 | 5.5 | No | 5.5 → 3.25(LP) → 1.15(LP) → 0.15 | 1.15 |
| 54 | 5.5 | No | 5.5 → 1.80(LP) → 0.40 | 1.80 |
| 55 | 5.5 | No | 5.5 → 1.80(LP) → 0.40 | 1.80 |
| Comp. steel | | | | |
| 56 | 5.5 | No | 5.5 → 3.25(LP) → 1.70(LP) → 0.30 | 1.70 |
| 57 | 5.5 | No | 5.5 → 3.25(LP) → 1.70(LP) → 0.30 | 1.70 |
| 58 | 5.5 | Yes | 5.5 → 3.25(LP) → 1.70(LP) → 0.30 | 1.70 |
| 59 | 5.5 | No | 5.5 → 3.25(LP) → 1.70(LP) → 0.30 | 1.70 |
| 60 | 5.5 | No | 5.5 → 3.25(LP) → 1.70(LP) → 0.30 | 1.96 |

TABLE 10

| | Tensile strength of patented wire (MPa) | Plating treatment | Final wire dia. (mm) | Reduction of area in wire drawing $\epsilon = 2\ln(D_0/D)$ |
|---|---|---|---|---|
| Steel of invention | | | | |
| 45 | 1428 | Brass plating | 0.200 | 3.89 |
| 46 | 1450 | Brass plating | 0.300 | 3.47 |
| 47 | 1473 | Brass plating | 0.200 | 3.82 |
| 48 | 1482 | Brass plating | 0.300 | 3.69 |
| 49 | 1491 | Brass plating | 0.300 | 3.64 |
| 50 | 1521 | Brass plating | 0.350 | 3.16 |
| 51 | 1530 | Brass plating | 0.350 | 3.28 |
| 52 | 1572 | Copper plating | 0.150 | 3.98 |
| 53 | 1590 | Nickel plating | 0.150 | 4.07 |
| 54 | 1528 | Brass plating | 0.400 | 3.01 |
| 55 | 1528 | Brass plating | 0.400 | 3.01 |
| Comp. steel | | | | |
| 56 | 1310 | Brass plating | 0.300 | 3.47 |
| 57 | 1453 | Brass plating | 0.300 | 3.47 |
| 58 | 1453 | Brass plating | 0.300 | 3.47 |
| 59 | 1545 | Brass plating | 0.300 | 3.47 |
| 60 | 1448 | Brass plating | 0.300 | 3.75 |

The steel wire was then subjected to final patenting, so that the structure and the tensile strength were adjusted, plating, and to final wet drawing. Tables 9 and 10 list the wire diameter at the time of patenting, the tensile strength subsequent to patenting and the final wire diameter subsequent to wire drawing of each of the steel wires.

The characteristics of these steel wires were evaluated by a tensile test, a twisting test and a fatigue test.

The fatigue characteristics in Table 11 of the steel wire were evaluated by measuring the fatigue strength of the steel wire by a Hunter fatigue test, and represented as follows: ⊕: the fatigue strength was at least 0.33 times as much as the tensile strength, O: the fatigue strength was at least 0.3 times as much as the tensile strength, and x: the fatigue strength was less than 0.3 times as much as the tensile strength.

TABLE 11

| | Tensile strength (MPa) | Reduction of area (%) | Fatigue characterisitcs |
|---|---|---|---|
| Steel of invention | | | |
| 45 | 3662 | 34.0 | ○ |
| 46 | 3624 | 32.6 | ○ |
| 47 | 4025 | 38.4 | ○ |
| 48 | 3980 | 31.5 | ○ |
| 49 | 4150 | 32.5 | ○ |
| 50 | 3602 | 36.0 | ⊕ |
| 51 | 3625 | 33.8 | ⊕ |
| 52 | 4220 | 36.8 | ○ |
| 53 | 4310 | 38.4 | ○ |
| 54 | 3550 | 36.4 | ○ |
| 55 | 3640 | 42.1 | ⊕ |
| Comp. steel | | | |
| 56 | 3482 | 36.2 | ○ |
| 57 | 3674 | 28.6 | x |
| 58 | — | — | — |
| 59 | 3633 | 28.4 | x |
| 60 | 3912 | 21.0 | x |

Figure 7:
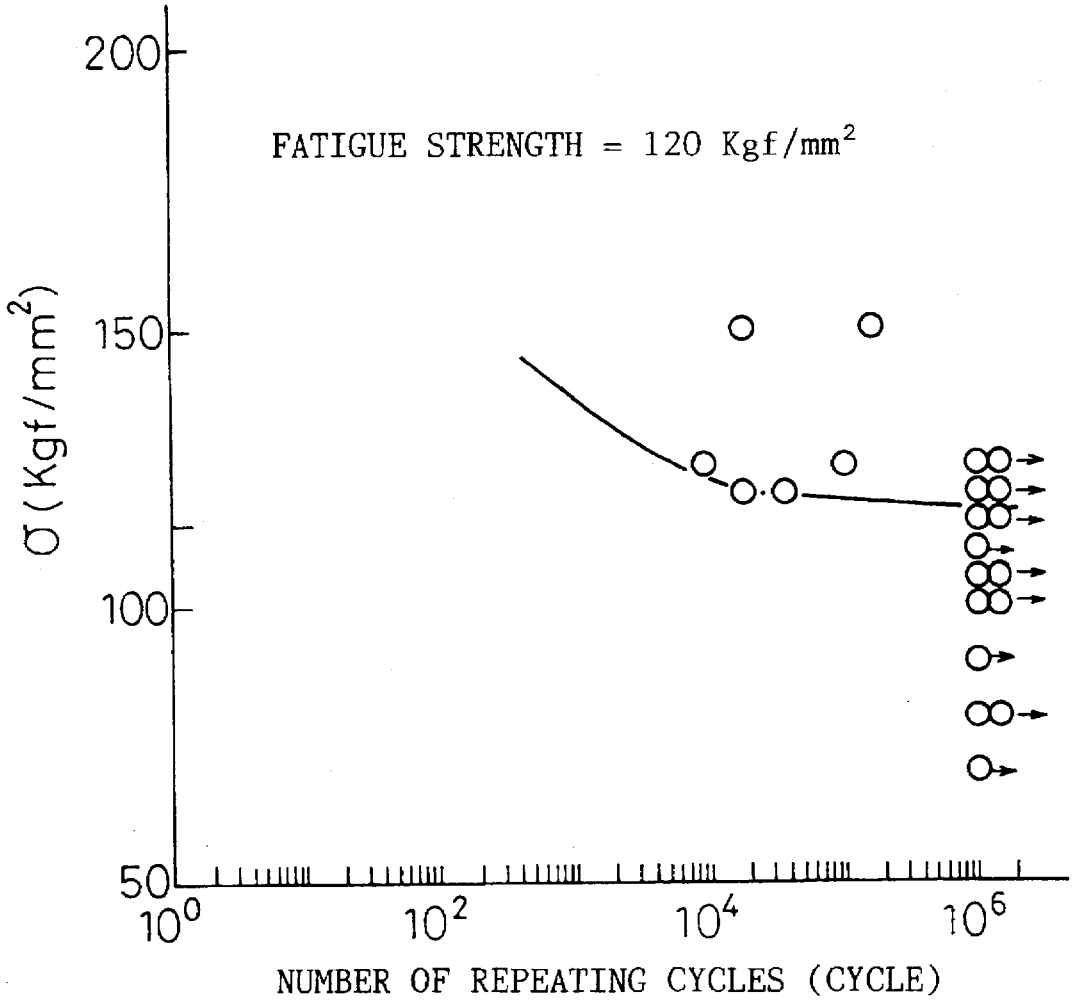
FIG. 7 is a graph showing a method for determining a fatigue limit.

Moreover, the fatigue strength by a Hunter fatigue test was defined as a strength under which the steel wire was not ruptured in the cyclic fatigue test with a number of repeating cycles up to $10^6$ (see FIG. 7).

Steels 45 to 55 in the table are steels of the present invention, and steels 56 to 60 are comparative steels.

Comparative steel 56 had a chemical composition outside the scope of the present invention but was produced by the same process.

Comparative steel 57 had a chemical composition within the scope of the present invention. However, the conformity of nonmetallic inclusions in the steel cast was low compared with that of the present invention. The process for producing a steel wire was the same as that of the present invention except for the conformity thereof.

Comparative steel 58 had the same chemical composition and the same composition of nonmetallic inclusions as those of the present invention, and primary cementite emerged in controlled cooling subsequent to hot rolling.

Comparative steel 59 had the same chemical composition and the same composition of nonmetallic inclusions as those of the present invention. However, the tensile strength of the finally patented steel wire became high compared with that obtained by the method in the present invention.

Comparative steel 60 had the same chemical composition and the same composition of nonmetallic inclusions as those of the present invention. However, the reduction of area in wire drawing subsequent to final patenting was larger than that of the present invention.

It can be understood from Table 11 that any of steel wires produced by the use of the steel of invention had a strength of at least 3,500 MPa and an excellent fatigue life.

On the other hand, in Comparative steel 56, since the C content was less than 0.90%, the chemical composition of the steel differed from that of the steel of the present invention. As a result, a strength of at least 3,500 MPa could not be obtained.

In Comparative steel 57, although the strength of at least 3,500 MPa was obtained, the composition of nonmetallic inclusions in the steel cast differed from that of the steel of the present invention. As a result, good fatigue characteristics could not be obtained.

In Comparative steel 58, since primary cementite emerged after hot rolling, wire breakage took place many times in the course of the wire production. As a result, the final wire could not be produced.

In Comparative steel 59, since the tensile strength obtained after final parenting was excessively high, the fatigue characteristics of the final steel wire were deteriorated, and good results could not be obtained.

In Comparative steel 60, since the reduction of area became excessively high in final wet wire drawing, the fatigue characteristics of the final steel wire were deteriorated, and good results could not be obtained.

INDUSTRIAL APPLICABILITY

As explained in the above examples, the present invention has been achieved on the basis of a knowledge that the precipitated phases as well as the average composition of nonmetallic inclusions should have low melting points, and that the composition of nonmetallic inclusions should be adjusted further from the compositions thus considered to a specified range. The present invention has thus realized nonmetallic inclusions having aspect ratios of at least 4 in a steel wire rod and at least 10 in a drawn wire, namely nonmetallic inclusions having extremely good workability. As a result, there can be obtained a steel wire rod of high strength and a drawn wire of high strength having a high strength, a high ductility and a good balance of high tensile strength and excellent fatigue characteristics.

We claim:

1. A steel wire of high strength excellent in fatigue characteristics comprising, by mass %, 0.7 to 1.1% of C, 0.1 to 1.5% of Si, 0.1 to 1.5% of Mn, up to 0.02% of P, up to 0.02% of S and the balance Fe and unavoidable impurities, and containing nonmetallic inclusions at least 80% of which comprise 4 to 60% of CaO+MnO, 22 to 87% of $SiO_2$ and 0 to 46% of $Al_2O_3$ and have melting points up to 1,500° C., and at least 70% of which have aspect ratios of at least 10.

2. A steel wire of high strength comprising, by mass %, 0.7 to 1.1% of C, 0.1 to 1.5% of Si, 0.1 to 1.5% of Mn, up to 0.02% of P, up to 0.02% of S, up to 0.3% of Cr, up to 1.0% of Ni, up to 0.8% of Cu and the balance Fe and unavoidable impurities, and containing nonmetallic inclusions at least 80% of which comprise 4 to 60% of CaO+MnO, 22 to 87% of $SiO_2$ and 0 to 46% of $Al_2O_3$ and have melting points up to 1,500° C., and at least 70% of which have aspect ratios of at least 10.

3. The steel wire of high strength excellent in fatigue characteristics according to claim 1, wherein the structure of the wire comprises at least 95% of a pearlitic structure.

4. The steel wire of high strength excellent in fatigue characteristics according to claim 1, wherein the structure of the wire comprises at least 70% of a bainitic structure.

5. The steel wire of high strength excellent in fatigue characteristics according to claim 2, wherein the structure of the wire comprises at least 95% of a pearlitic structure.

6. The steel wire of high strength excellent in fatigue characteristics according to claim 2, wherein the structure of the wire comprises at least 70% of a bainitic structure.

* * * * *